US006772888B2

(12) United States Patent
Burke

(10) Patent No.: US 6,772,888 B2
(45) Date of Patent: Aug. 10, 2004

(54) ADJUSTABLE FORWARD FEEDING DISPLAY SYSTEM

(75) Inventor: Robert P. Burke, Laguna Niguel, CA (US)

(73) Assignee: Burke Display Systems, Inc., Dana Point, CA (US)

( * ) Notice: Subject to any disclaimer, the term of this patent is extended or adjusted under 35 U.S.C. 154(b) by 0 days.

(21) Appl. No.: 09/379,704

(22) Filed: Aug. 24, 1999

(65) Prior Publication Data

US 2003/0010732 A1 Jan. 16, 2003

(51) Int. Cl.[7] ..... A47F 1/04

(52) U.S. Cl. ..... 211/59.3; 211/51; 312/71

(58) Field of Search ..... 211/51, 59.2, 593, 211/59.4, 184, 43; 312/71, 61

(56) References Cited

U.S. PATENT DOCUMENTS

| | | | | |
|---|---|---|---|---|
| 2,934,212 A | * | 4/1960 | Jacobson | 211/49 |
| 3,161,295 A | | 12/1964 | Chesley | |
| 3,308,961 A | | 3/1967 | Chesley | |
| 4,300,693 A | | 11/1981 | Spamer | |
| 4,303,162 A | | 12/1981 | Suttles | |
| 4,504,100 A | | 3/1985 | Chaumard | |
| 4,724,968 A | | 2/1988 | Wombacher | |
| 4,730,741 A | | 3/1988 | Jackle, III et al. | |
| 4,762,236 A | | 8/1988 | Jackle, III et al. | |
| 4,821,894 A | | 4/1989 | Dechirot | |
| 4,830,201 A | | 5/1989 | Breslow | |
| 4,898,282 A | | 2/1990 | Hawkinson et al. | |
| 4,899,893 A | * | 2/1990 | Robertson | 211/59.3 |
| 4,901,869 A | | 2/1990 | Hawkinson et al. | |
| 4,907,707 A | | 3/1990 | Crum | |
| 5,012,936 A | | 5/1991 | Crum | |
| 5,069,349 A | | 12/1991 | Wear et al. | |
| 5,088,607 A | | 2/1992 | Risafi et al. | |
| 5,111,942 A | | 5/1992 | Bernardin | |
| 5,203,463 A | | 4/1993 | Gold | |
| 5,240,126 A | | 8/1993 | Foster et al. | |
| 5,265,738 A | | 11/1993 | Yablans et al. | |
| 5,366,033 A | | 11/1994 | Koivisto | |
| 5,366,099 A | * | 11/1994 | Schmid | 211/59.3 |
| 5,390,802 A | | 2/1995 | Pappagallo et al. | |
| 5,413,229 A | | 5/1995 | Zuberbuhler et al. | |
| 5,450,968 A | | 9/1995 | Bustos | |
| 5,450,969 A | | 9/1995 | Johnson et al. | |
| 5,469,976 A | * | 11/1995 | Burchell | 211/59.3 |

(List continued on next page.)

OTHER PUBLICATIONS

VP–2 Assembly Instructions (Level 1), *Space Management Systems, Inc.*, 10/90, pp. 424–428.
Shelf Management System photographs A –N.
Four photographs of two slide members.

*Primary Examiner*—Leslie A. Braun
*Assistant Examiner*—Khoa Tran
(74) *Attorney, Agent, or Firm*—Knobbe, Martens, Olson & Bear, LLP

(57) ABSTRACT

An adjustable display rack is used in a shelf management system. The rack stores and displays products of a variety of shapes and sizes and automatically delivers the products to the front of the rack. The adjustable display rack includes a frame and a product supporting and feeding assembly. The assembly includes product tracks that can be added or removed as needed and that can be separated by varying distances depending on the width desired. The assembly also includes dividers. The product tracks and dividers can be separate or integral. The product tracks have raised rails extending from a front of the track to a back of the rack for attachment of a removable pusher block and a roll spring which urges the pusher block forward. Additionally, a spacer block can be fitted onto the pusher block to increase its height and width or used to change the spacing between the tracks. The tracks are generally freely slidable in races formed within the frame.

13 Claims, 9 Drawing Sheets

U.S. PATENT DOCUMENTS 5,542,552 A 8/1996 Yablans et al.
5,562,217 A 10/1996 Salveson et al.
5,605,237 A 2/1997 Richardson et al.
5,634,564 A 6/1997 Spamer et al.
5,638,963 A * 6/1997 Finnelly et al. ..... 211/59.3
5,665,304 A 9/1997 Heinen et al.
5,673,801 A * 10/1997 Markson ..... 211/59.3
5,685,664 A 11/1997 Parham et al.
5,746,328 A * 5/1998 Beeler et al. ..... 211/59.3
5,806,690 A * 9/1998 Johnson et al. ..... 211/59.3
5,839,588 A 11/1998 Hawkinson
5,855,283 A * 1/1999 Johnson ..... 211/59.3
5,873,489 A * 2/1999 Ide et al. ..... 211/279
5,992,653 A * 11/1999 Anderson et al. ..... 211/59.3
6,082,557 A * 7/2000 Leahy ..... 211/59.3
6,142,317 A * 11/2000 Merl ..... 211/59.3
D445,615 S * 7/2001 Burke ..... D6/509
6,382,431 B1 * 5/2002 Burke ..... 211/59.3

* cited by examiner

ADJUSTABLE FORWARD FEEDING DISPLAY SYSTEM

FIELD OF THE INVENTION

The present invention generally relates to an adjustable display rack and shelf management system. More specifically, the present invention relates to an adjustable forward feeding display rack for storing and displaying merchandise of a variety of shapes and sizes and automatically delivering the merchandise to the front of the rack in seriatim.

BACKGROUND OF THE INVENTION

Shelving is used extensively for stocking and storing products or merchandise in a variety of stores. Most stores have immovable shelving which is arranged back-to-back between aisleways. The nature of the fixed shelves makes it difficult to add and remove products. Moreover, such shelves make difficult the rotation of the shelved products, which involves moving the older stock to the front of the shelf and positioning new stock behind the older stock.

In order to devise a means for automatically moving products forward as they are removed, numerous forward feed devices have been devised. These devices fall into three categories. The first category is inclined tracks relying on gravity to feed the product forward. Gravity feeding is unpredictable in that various materials slide faster than others because of different weights and frictional interfaces between the products and the track. The second category tries to overcome these problems by adding conveyor belts which still use gravity to effect forward movement. Of course, such devices are cumbersome, expensive and complicated due to the need to properly tension and track the conveyor belts.

The third category uses springs to feed the product forward. The springs result in a simple, inexpensive design which will smoothly move products forward. There have been a number of variations on this type of design.

SUMMARY OF THE INVENTION

Many spring-biased devices have the disadvantage that they can only be used for a very limited size of product. In addition, even if designed for variations in size, the designs are complicated and difficult to alter. Moreover, it has been discovered that most spring biased devices cannot tolerate high loads and that such loads may often disengage the spring-biasing assembly from the display rack.

Accordingly, the present invention involves an adjustable forward feeding display system. The display system is adjustable in a direction transverse to the direction of feeding, meaning the present display system is specifically designed to adjust to compliment containers and packaging having various widths. Moreover, the present display system also involves a simplified assembly process, as well as a stable spring biasing assembly. The present display system also benefits from a stable connection to both the front and rear portions on the display rack, such that the product tracks in and any dividers in-between the product tracks are securely locked to the front and rear of the display rack while still allowing the tracks and dividers to translate transverse to the front and rear of the display rack.

Accordingly, one aspect of the present invention involves a pusher block and track combination. The track generally comprises a pair of collinear substantially T-shaped ridges.

The pusher block has two sets of opposing flanges. The opposing flanges attach to the track at more than the top and outside surface of the rail, such that the track is captured by the pusher block with each ridge captured between a corresponding set of opposing flanges.

Another aspect of the present invention involves an adjustable display rack for storing and displaying products in a shelf-like orientation. The display has a frame with a front panel and a back panel. The front panel and the back panel extend generally parallel to one another and are separated by a fixed distance. The front panel and the back panel include races that extend along the front and back panels. The display rack further comprises one or more product tracks having raised rails extending generally transverse to the front and back panels and a removable pusher block slidably attached to the product track. A biasing member biases the pusher block forward, and at least one divider is positioned between two adjacent product tracks. The product tracks and dividers are slidably attached to the races of the front panel and the rear panel and allow for translational movement of the product tracks and dividers.

Yet a further aspect of the present invention involves a pusher block and track combination. The track includes a pair of raised rails having a generally T-shape. The pusher block has at least two sets of opposing flanges, wherein the opposing flanges attach to one of the rails at more than the top and outside surface of the rail, whereby the rail is captured between the set of opposing flanges, but slides backward and forward on the flanges.

A further object of the invention is an adjustable display rack for storing and displaying products in a shelf-like orientation. The rack comprises a frame with a front panel and a back panel extending generally parallel to each other and being a substantially fixed distance relative to one another. The front panel and the back panel include races and corresponding removable pusher block assemblies. The rack further comprises one or more product tracks. The product tracks include raised rails extending generally transverse to the front and back panels and being generally T-shaped. The removable pusher block assembly includes a pusher block slidably attached to the product track. The pusher block comprises two sets of opposing flanges. The flanges are arranged to capture the rails on both side edges of both rails. The pusher block assembly also has a biasing member urging the pusher block forward along the track. At least one divider is positioned between two adjacent product tracks and the product tracks and dividers are slidably attached to the races to allow movement of the product tracks and dividers from side to side along the front panel and the rear panel.

BRIEF DESCRIPTION OF THE DRAWINGS

These and other features, aspects and advantages of the present invention will now be described with reference to the drawings of a preferred embodiment, which embodiment is intended to illustrate and not to limit the invention, and in which figures.

DETAILED DESCRIPTION OF THE PREFERRED EMBODIMENT

Figure 1:
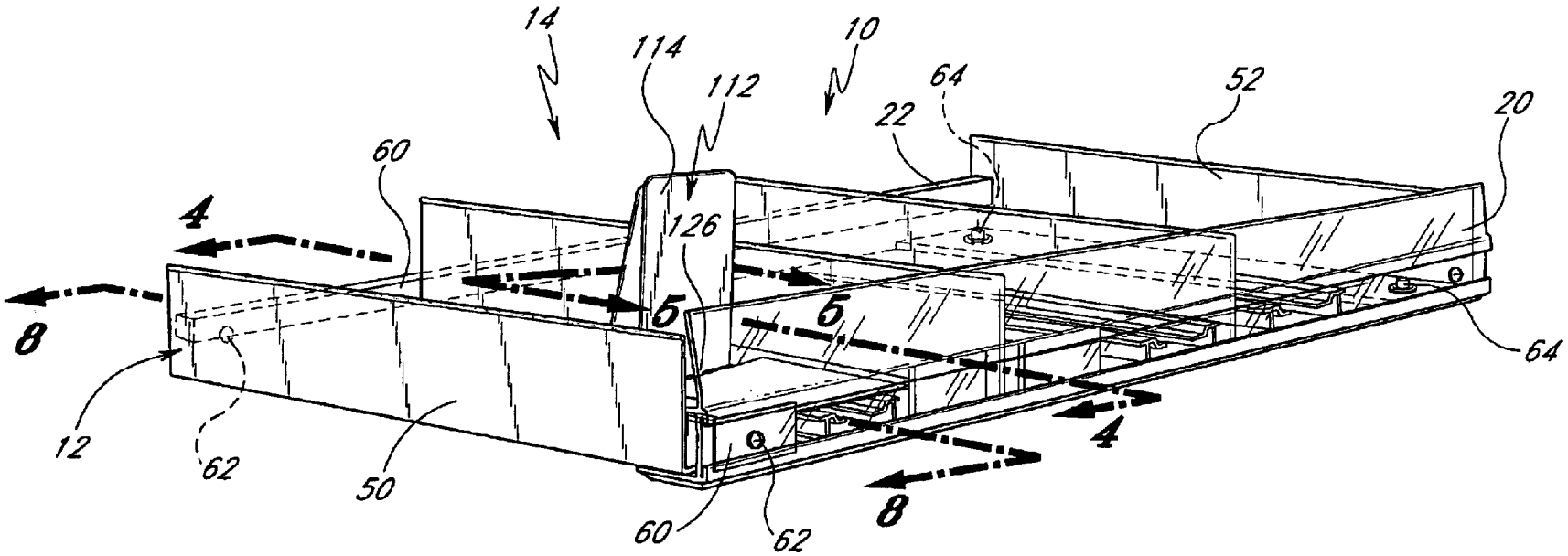
FIG. 1 is a perspective view of an adjustable display rack having various features, aspects and advantages in accordance with the present invention.

With reference initially to FIG. 1, an adjustable display rack for use as a shelf management system, generally designated by reference numeral 10, is illustrated. The adjustable display rack is configured and arranged to accept packages of various sizes, weights and configurations. For instance, the present adjustable display rack may be commonly used with prepackaged and bagged salads and other types of produce. Additionally, in one embodiment, the present adjustable display rack 10 may have particular utility with pharmaceutical products, such as drugs and vitamins. While the present invention is typically used with comestible products in stores such as grocery stores and convenience marts, the present adjustable display rack may find utility in a variety of other environments, including warehouses, hospital, drug store, and office supply rooms, auto parts stores and clothing stores, for instance, but without limitation.

The present adjustable display rack 10 is generally comprised of a frame 12 and a product supporting and feeding assembly 14. While the illustrated frame 12 may be simply placed upon a shelf or other similar structure, it is contemplated that the frame 12 may be positioned within a slidable drawer not shown, such that the drawer may be pulled out to provide access to the entire frame where the adjustable display racks 10 are oriented in close vertical relationship to one another. Such a slideable mounting assembly will ease the rotation of product positioned within the display rack 10 by allowing the stock person full access to the full dimension of the product supporting and feeding assembly 14.

Figure 4:
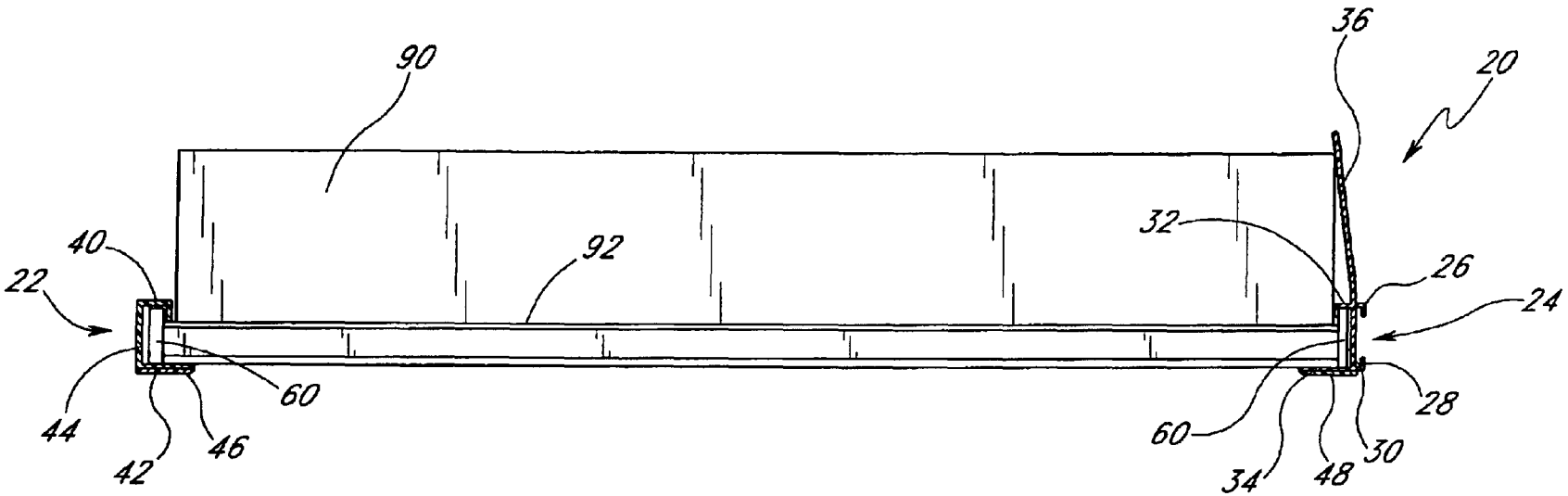
FIG. 4 is a sectioned view of the display rack of FIG. 1 taken along the line 4—4.

With continued reference to FIG. 1, the frame 12 generally comprises a first and second end. In the preferred embodiment the first and second end are a front panel 20 and a rear panel 22. The panels 20, 22 extend generally parallel to one another at a substantially fixed distance. With reference now to FIG. 4, the panels 20, 22 will be discussed in detail in seriatim beginning with the front panel 20. The front panel 20 generally comprises an inverted F configuration. Specifically, the front panel 20 includes a forward facing channel 24 generally defined by an upper lip 26 and a lower lip 28. The channel 24 is desirably sized and configured to accommodate sku identifiers or other product identification and pricing information to be positioned proximate to products which may be positioned and displayed in the adjustable display rack 10. The front panel 20 also comprises a rearward-facing race 30. The race 30 is generally defined by an upper flange 32 and a lower support surface 34. The race 30 is preferably sized and configured to allow free movement of product tracks and dividers in manners which will be described in greater detail below. With continued reference to FIG. 4, a product retaining wall 36 desirably extends upward between the forward-facing channel 24 and the race 30 and preferably angles slightly rearward from a location above the upper lip 26 and the upper flange 32. The product retaining wall 36 serves as a forwardmost stopping surface for the adjustable display rack 10 and is desirably angled rearward to help pinch and hold product within the adjustable display rack 10 while the product is being urged forward in manners to be described in greater detail below.

With continued reference to FIG. 4, the rear panel 22 is advantageously configured in a simple C shape. As such, the rear panel 22 generally comprises an upper flange 40 and a lower support surface 42. As with the front panel 20, the upper flange 40 and the lower support surface 42 generally define a race 44 within the rear panel 22. The race 44 is preferably sized and configured similar to the race 30. The lower support surface 42, as well as the lower support surface 34, desirably extend at greater length toward one another than the upper flange 32 and the upper flange 40. The greater extension increases the surface contact area between the lower support surfaces 34, 42 and any base structure, such as a shelf or a drawer on which the adjustable display rack 10 rests. In the illustrated configuration, the lower support surfaces 34, 42 each receive a magnetized material which forms an additional layer below the lower support surfaces. This additional layer 46, 48 may extend the entire transverse length (i.e., the length from one end to the other of the front panel 20 and the rear panel 22) or may be segregated into shortened portions serving as feet for the adjustable display rack 10. In some embodiments, the additional layers 46, 48 may not be necessary, while in other embodiments, the additional layers 46, 48 may comprise rubberized components for shock absorption and the like, as well as Velcro or other suitable securing and supporting components.

With reference again to FIGS. 1–3, the frame 12 of the present adjustable display rack 10 also generally comprises a first and second side. In the preferred embodiment, the first and second side are end pieces 50, 52. The end pieces 50, 52 may be distinct elements or may be portions of the product supporting and feeding assembly 14 which will be discussed in detail below.

Figure 5:
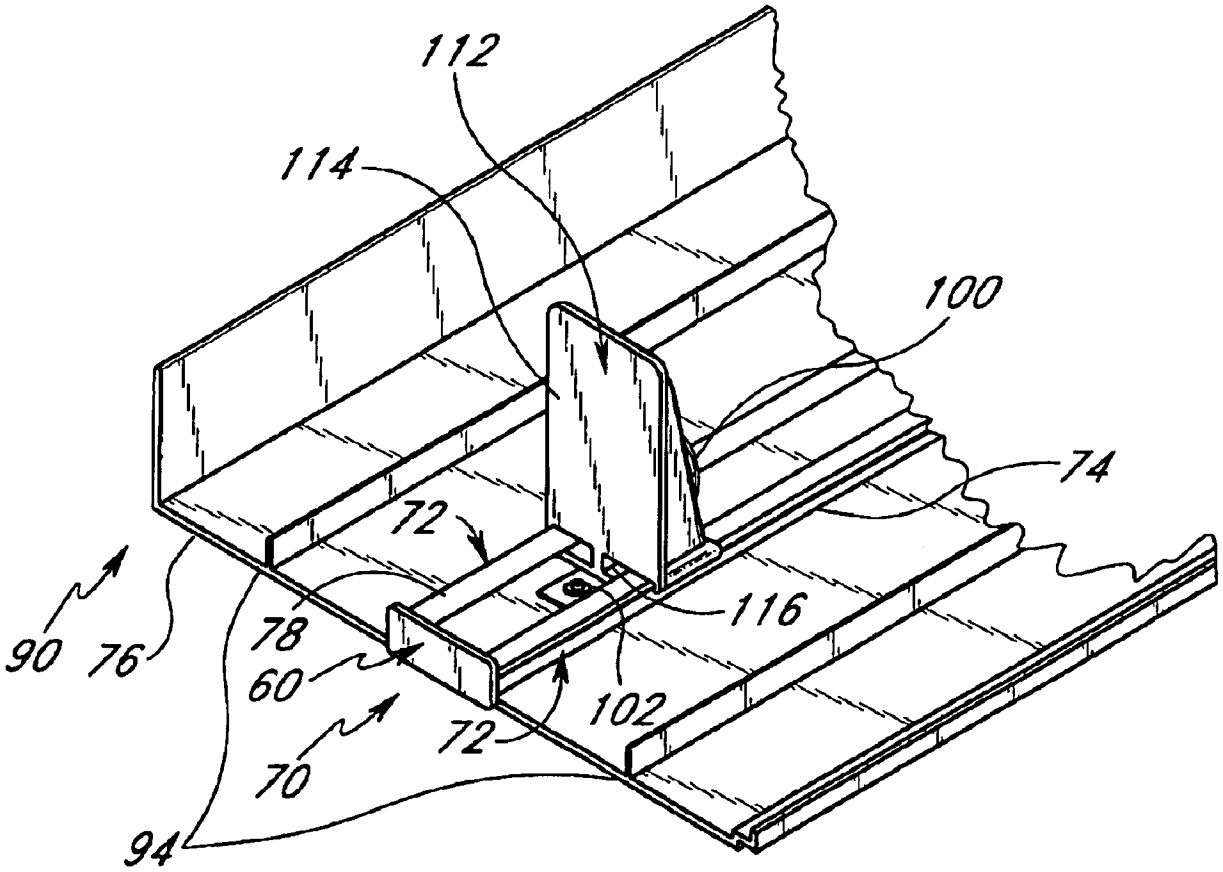
FIG. 5 is a perspective view of a portion of an integrated track and divider that can be used with a display rack such as that illustrated in FIG. 1.

In the illustrated display rack, the end pieces 50, 52 are distinct elements. With reference to FIGS. 1 and 5, the left end piece 50 is attached to the front panel 20 and the rear panel 22 through the use of an end clip 60. The end clip 60 may be attached to the left end piece 50 in any suitable manner. In the illustrated embodiment, the left end piece is formed as a section of track which has a configuration which will be described below. However, the end clip 60 slides into a portion of the track and is allowed to be fixed within the track without the use of any glue or other adhesive material. The end clip will be described in more detail later, but slides into the rails/ridges 72 of the product track 70 and/or the dividing wall 90 at one or both ends.

Referring again to the frame, the end piece 50 is preferably attached to the front panel 20 and the rear panel 22 with a threaded fastener 62 at both the front and the rear panels 20, 22. The left end piece 50 may also be removably attached to the front panel 20 and the rear panel 22 using any other suitable method, including directly fastening the front panel 20 and the rear panel 22 to the end piece 50 such as through the lower support surfaces 34, 42.

With continued reference to FIG. 1, the right end piece 52 is preferably permanently or semi-permanently fastened to the front panel 20 and the rear panel 22 such as through rivets 64. It is envisioned, however, that both end panels may be removably fastened to the front panel 20 and the rear panel 22, as well as the end pieces 50, 52 being configured such that one is attached permanently or semi-permanently while the other is removably attached. The removability of the end pieces 50, 52 creates a self-contained display rack 10 that may be reconfigured for various size products quickly and easily by removing one of the end pieces 50, 52 or both of the end pieces 50, 52 and altering the size or lateral dimension of any of the members of the product supporting and feeding assembly 14 which will be described in detail below.

The display rack also comprises a track to underlie a plurality of said products. The track extends longitudinally between first and second ends, and laterally between first and second sides. In the preferred embodiment the track comprises the product track 70. With continued reference to FIG. 1, the present product supporting and feeding assembly 14 will be described in greater detail. As illustrated, the present product supporting and feeding assembly 14 generally comprises a number of product tracks and dividers. In some instances, the product tracks and dividers are integrally formed (i.e., formed of a single piece—see FIG. 5) and in other instances, the product tracks are separate from the dividers to add increased flexibility to the sizing of the products which may be carried by the product tracks and dividers (See FIGS. 6 and 7). In most instances, the dividers will include a portion or a segment of product track to allow the divider to also function as a support surface. Moreover, the product tracks and the dividers having support surfaces will use ridges to decrease the contact surface area between the packages and the product supporting and feeding assembly 14 such that friction may be reduced between the products and the assembly 14. With this introduction, the assembly 14 will be described.

Figure 6:
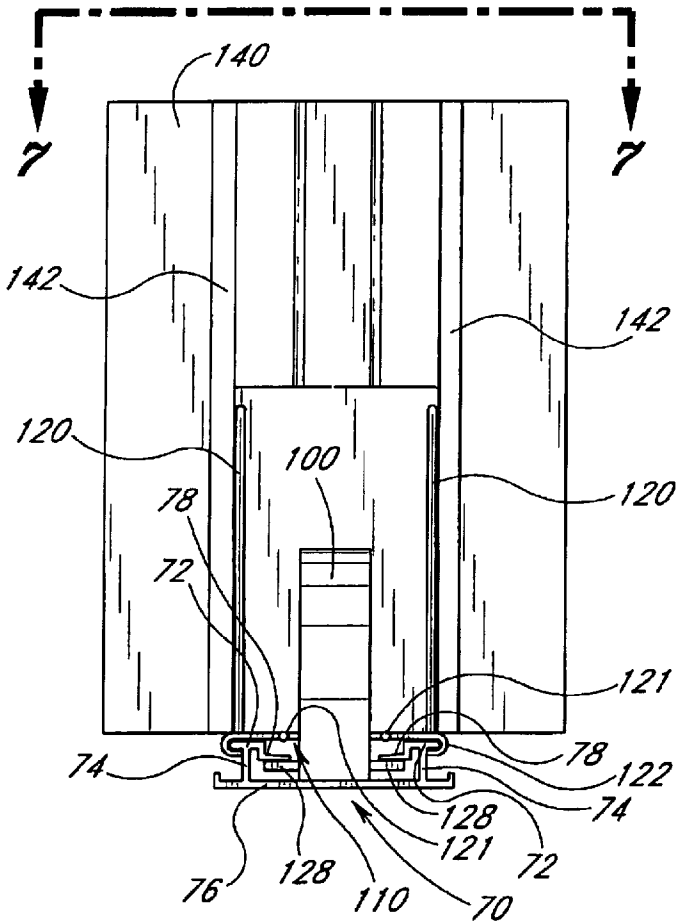
FIG. 6 is a sectioned view of a single product track and block of a display rack similar to that illustrated in FIG. 1.

With reference now to FIG. 6, a typical product track 70 arranged and configured in accordance with certain features, aspects and advantages of the present invention will be described in detail. While the illustrated product track 70 is but one configuration for such tracks, it is the presently preferred embodiment. The product track 70 generally comprises a pair of rails or ridges 72 that extend in a collinear fashion substantially the depth of the display rack 10. The rails 72 have a flattened upper surface to slightly increase the support surface area for carrying product. The upper surface, however, is not so large that an increased friction may result such that product cannot be moved under the available forces for the product supporting and feeding assembly 14. The rails 72 further comprise a generally vertically extending rib 74. The rib 74 spaces the rails 72 from a lower support surface 76. As illustrated clearly in FIG. 6, the rails, rib and lower support surfaces 72, 74, 76 create a double I cross-sectional shape. The lower support surface 76 is preferably continuous between the two sets of rails and ribs 72, 74. It should be understood that while the presently preferred product track 70 is a straight extrusion of the plastic material, it is envisioned that the rib or the lower support surface 74, 76 may be intermittent along the length of the rails 72 such that the rib 74 or the lower support surface 76 is not continuous with the entire length of the rails 72. With continued reference to FIG. 6, the rails 72 terminate at an inward edge with a sloping tie down surface 78. The tie down surface 78 cooperates with a pusher block or product pusher which reciprocates along the longitude of the product track in manners which will be described in greater detail below.

Figure 8:
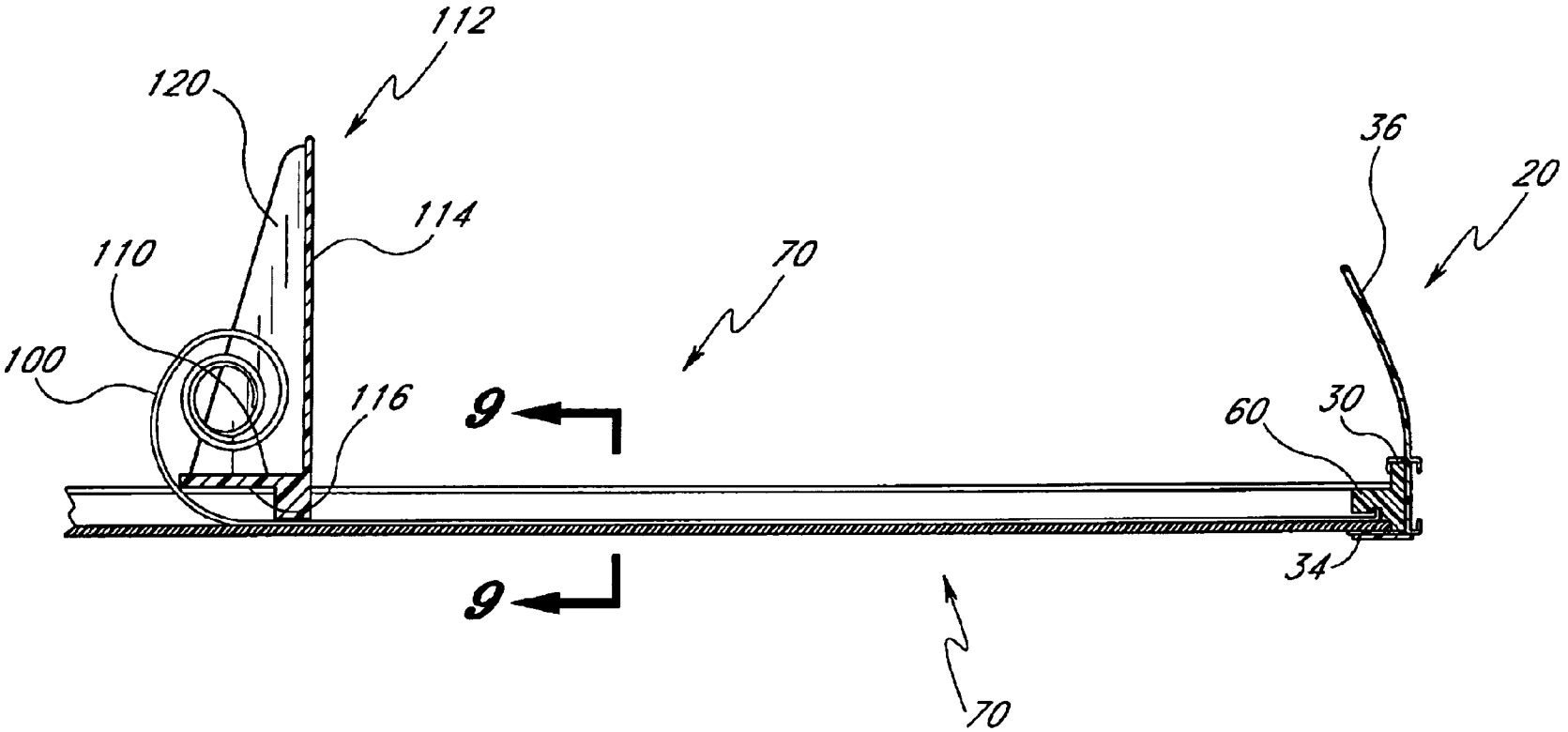
FIG. 8 is a sectioned view of a product track configured and arranged in accordance with various features, aspects and advantages of the present invention.

The tracks are slidably engaged at both ends in a first and second guide lying transverse to the longitudinal extensions of each track. In the preferred embodiment the guides are races 30, 44 and the tracks are product tracks 70. With reference now to FIGS. 8 and 4, it can be seen that both ends of the product track 70 extend to the races 30, 44 and are captured therein with or without an end clip 60. In this manner, each of the product tracks 70 are generally restrained for translational movement from side to side along the front panel 20 and the rear panel 22. Additionally, this configuration results in a secure connection of the product tracks 70 with the frame 12 such that the product track 70 cannot flop around such as might occur with a track that is only connected at either the front or rear panel 20, 22. The end clip 60 may be attached to the product track 70 in any suitable manner, including friction fitting, threaded fasteners, fasteners, detents, and any other suitable method.

Figure 2:
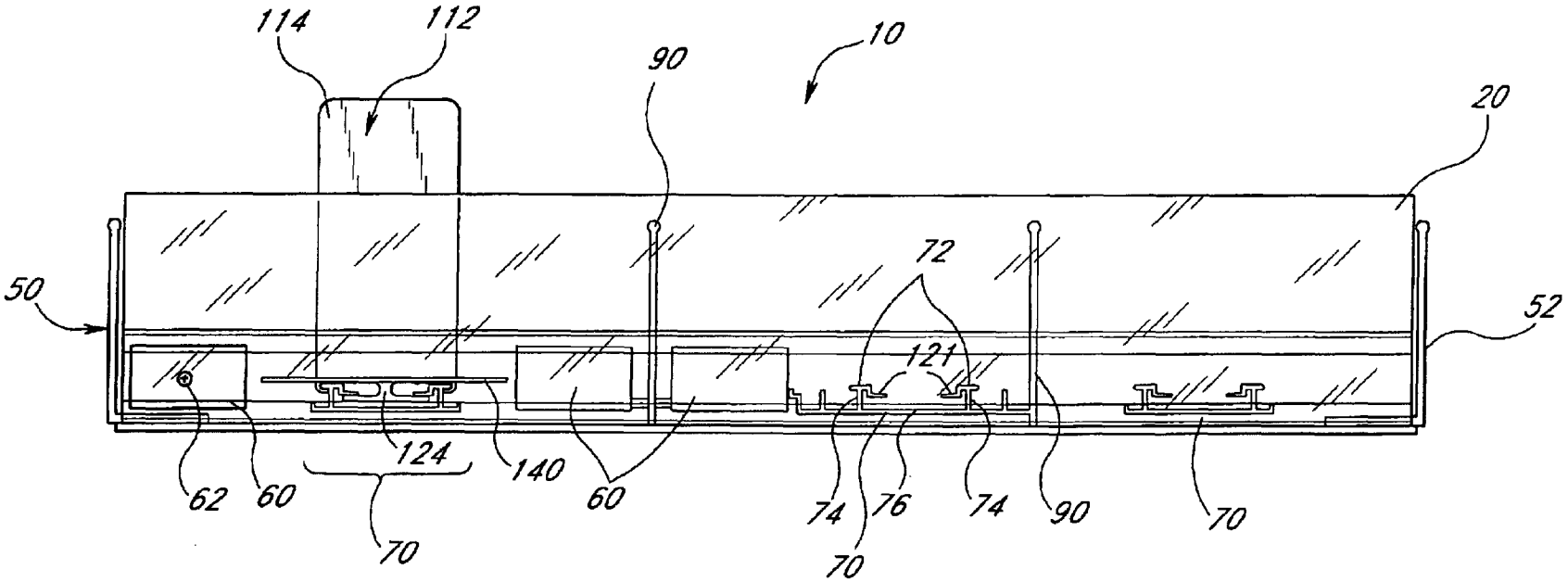
FIG. 2 is a front elevation view of the adjustable display rack of FIG. 1.

With reference now to FIG. 2, two adjacent product tracks 70 are preferably separated by a dividing wall 90 such that product carried by one product track 70 will not interfere with the movement of product carried by an adjacent product track 70. The dividing wall 90 may take on any suitable configuration and in some embodiments, carries the same cross-sectional profile as a product track with the addition of an upward extending wall at one outer edge of the lower support surface 76. In some embodiments, the dividing wall 90 has an L-shaped configuration, while in other embodiments the dividing wall 90 has a T-shaped configuration. It is also possible to configure a dividing wall 90 without a product supporting surface 92. For instance, the dividing wall 90 may be attached to a pair of end clips 60 such that one is positioned at each end (see FIGS. 1 and 5). In this configuration, the end clips 60 could attach the dividing wall 90 to the front panel 20 and the rear panel 22 for sliding movement therein. As discussed above, the dividing wall 90 may also be combined with a product track 70 such as that illustrated in FIG. 5.

With reference to FIG. 5, the product track 70 is generally comprised of the same rails, ribs, lower support surface and tie down surfaces 72, 74, 76, 78 as discussed above. However, the lower support surface 76 extends to both sides of the product track 70 and includes a pair of upwardly extending ribs 94 that serve to carry a product. The upwardly extending ribs 94 also decrease friction between the product and the product track 70 by decreasing surface contact area. Additionally, the lower support surface 76 extends outward into a dividing wall 90 at one of the left or right ends. The particular configuration of the product tracks and dividing walls may vary upon application to allow proper sizing of the product supporting and feeding assembly for any specific display rack 10. The product supporting and feeding assembly 14 described thus far advantageously allows a store operator to quickly and easily reconfigure the shelves within the store to accept products of varying sizes and shapes without ordering a complete replacement display rack. Moreover, the versatility of the present adjustable display rack 10 is dramatically increased by the interchangeable nature of the product tracks 70 and dividing walls 90, as well as the combined product tracks/dividing wall described directly above.

Figure 10:
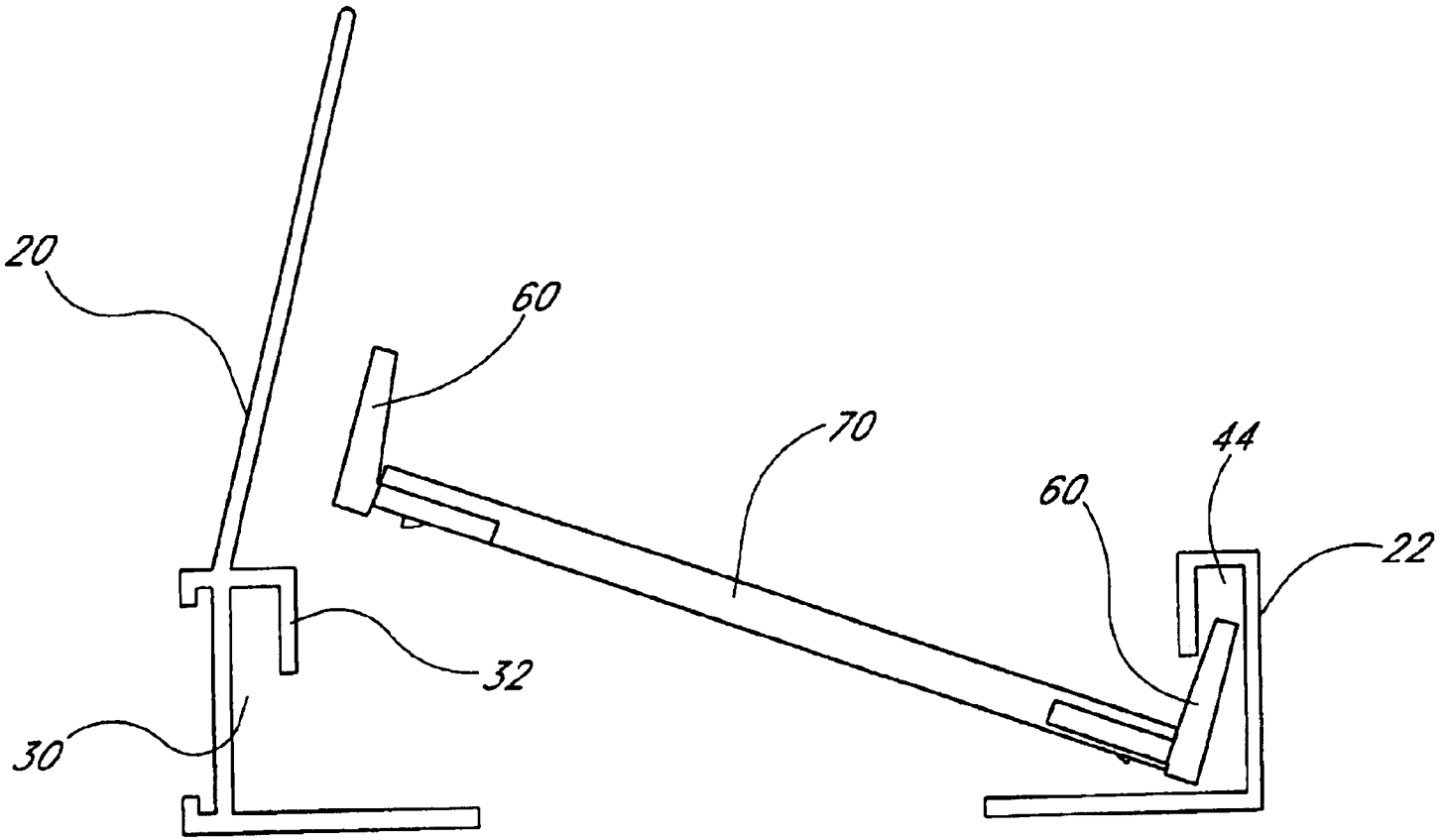
FIG. 10 is a side view of an embodiment in which the product tracks and dividers are snap fit into the front and rear races.

While it has been disclosed that one end 50, 52 of the frame 12 may be removed to allow the replacement and/or removal or addition of a product track 70 or a dividing wall 90, as shown in FIG. 10, it is also envisioned that a product track 70 or dividing wall 90 may simply be snap fit into the frame 12 such that the end clips 60 attach the track 70 or dividing wall 90 for sliding movement relative to the frame after being snapped in. Along these lines, the tracks 70 and walls 90 may be configured similar to a ski boot binding wherein the one end of the track 70 or dividing wall 90 is slipped into either the front or rear panel 20, 22 and then snapped into place in the other of the panels 20, 22. In one embodiment, at least a portion of the upper flange 32 may have increased flexibility to allow the end clip 60 to slide into the race 30 more easily. Additionally or alternatively, the angle on the inside top of the race 32 can be changed to allow this flexibility.

Additionally, the races 30, 44 may include an entrance slot such that product tracks 70 and dividing walls 90 may be inserted and/or removed in various locations along the length of the race 30, 44. Additionally, the product tracks 70 and the dividing walls 90 may be separated by spacer blocks 96 such as those illustrated in FIG. 3. The spacer blocks may be arranged and configured in any suitable manner and likewise may be attached to the front panel 20, rear panel 22, or any of the dividers 90 or product tracks 70.

Figure 7:
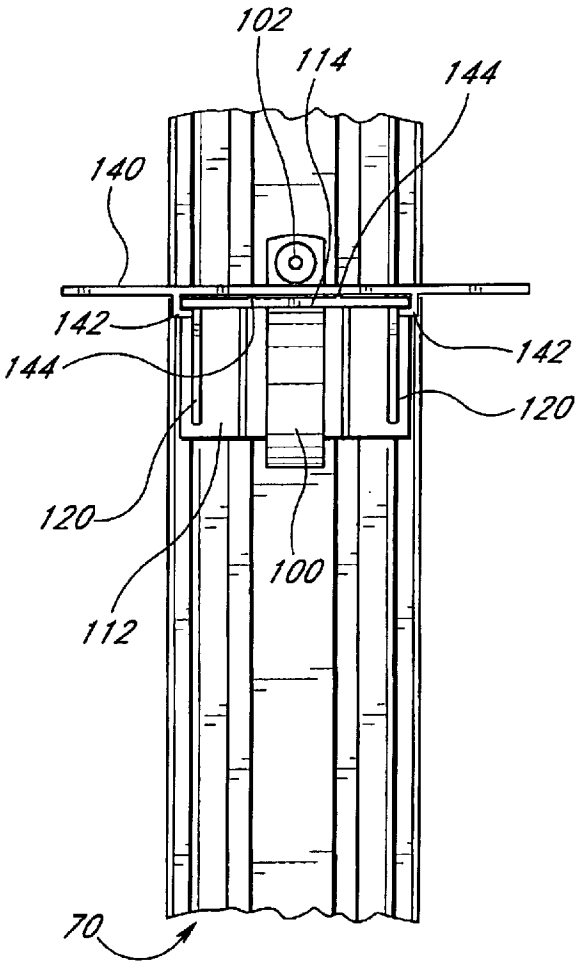
FIG. 7 is a top plan view of FIG. 6.

The product pusher comprises a spring which biases the product pusher toward the end of the track and a sliding connection between the track and the product pusher. With reference now to FIGS. 6–8, the biasing assembly for the forward feeding product supporting and feeding assembly 14 will be described in detail. As illustrated therein, the biasing member is preferably a roll spring 100. The roll spring 100 has characteristics which make it desirable over various other springs, such as compression springs. For instance, the roll spring 100 naturally recoils after being extended and released. The recoiling involves rolling of the coil into its tightly wound initial state. As the roll spring 100 is stretched, the force exerted by the roll spring 100 varies unlike that of coil springs in which the force is approximately the same during such stretching.

Of course, coil springs may be used, however, they are not the presently preferred embodiment. Moreover, elastic straps, ropes, and a variety of other springs and biasing members may be used. However, they are not the presently preferred biasing member for a number of reasons. A roll spring provides a uniform force throughout its extension, is simple to install and doesn't require attachment to the pusher block. The roll spring 100 may be permanently, semi-permanently or removably attached to the product track 70. It is presently preferred, however, that the roll spring 100 be permanently or semi-permanently attached to the product track 70 through the use of a rivet 102. It is envisioned, however, that threaded fasteners, fasteners, pins, connectors and couplings of any suitable type may also be used.

The balance of the roll spring 100 rests on a spring carrying surface 110 of a product pusher or pusher block, indicated generally by the reference numeral 112. Due to the unique configuration of the roll spring, no permanent attachment or semi-permanent attachment is necessary to maintain the spring's position on the spring carrier surface. Indeed, the forward tension of the roll spring which would be opposed by any product positioned forward of the pusher block 112 would help to maintain the position of the roll spring 100 on the spring carrier surface 110.

Figure 3:
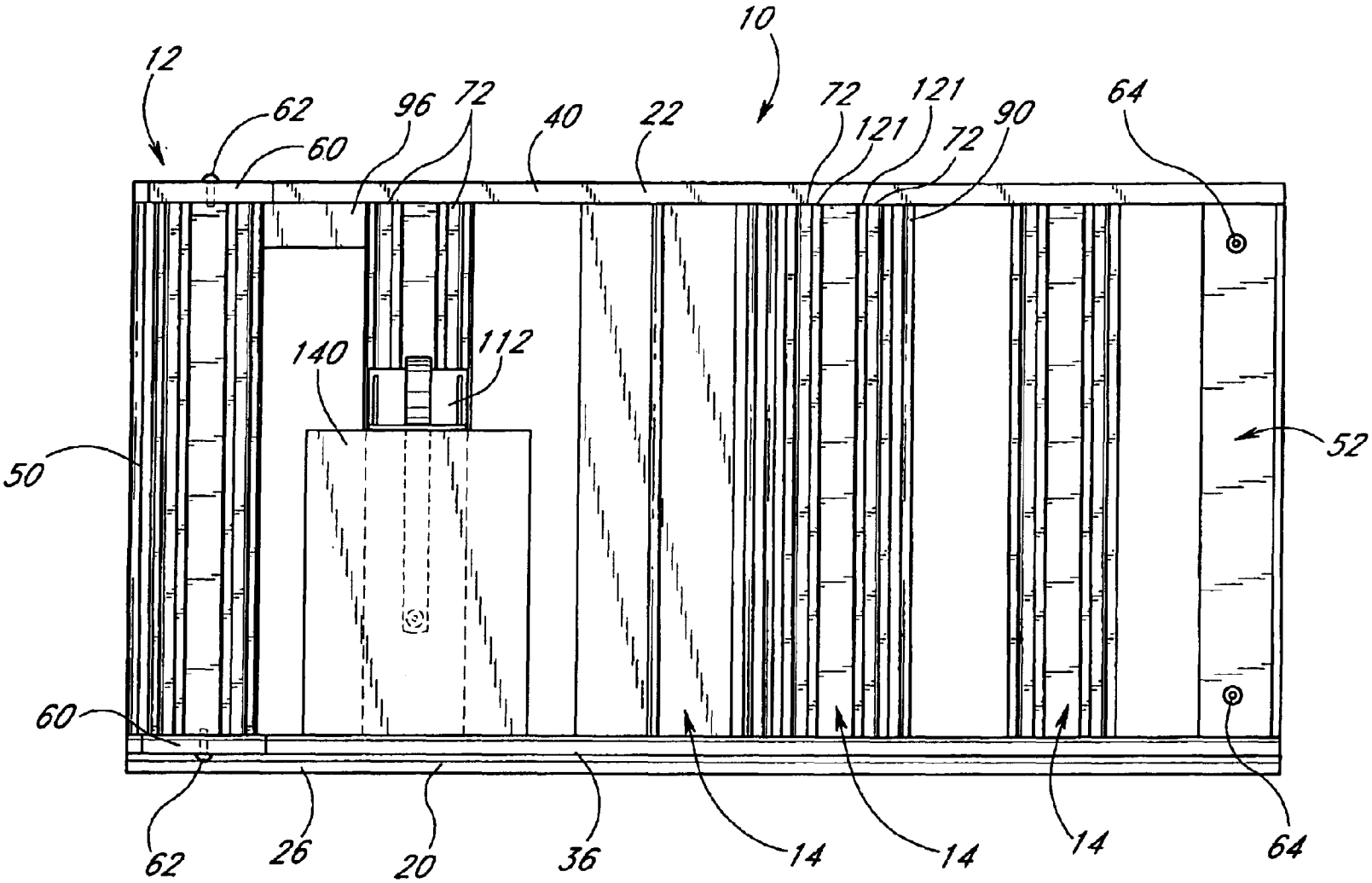
FIG. 3 is a top plan view of the display rack of FIG. 1.

With reference now to FIG. 8, it may also be seen that the forward portion of the roll spring may be positioned and attached to the forward end clip 60 in any suitable manner. In this way, the pusher block 112 may slide all the way forward to the product retaining wall 36 rather than being artificially stopped by the position of the rivet 102 or other attachment method of the forward end of the roll spring 100. In embodiments such as the one illustrated in FIG. 8 in which the pusher block can traverse substantially the entire length of the product track 70, a spacing member 140 may be positioned forward of the pusher block 112 along the product track 70 such that the forward motion of the pusher block 112 may be limited as shown in FIG. 3. For example, as shown in FIG. 3, the paddle 140 can be positioned on the rails/ridges 72 between the product and the front panel 20. In continued reference to FIG. 8, the forward portion of the roll spring 100 is bent upward in position resting on the spring carrier surface 110 of the pusher block 112 and held in position by forces exerted between the end clip 60 and the lower support surface 34. This, in effect, captures the end of the roll spring 100 within the end clip. However, the spring is recessed in the end clip such that it is still slidable in the races.

The illustrated product pusher is in sliding connection with the product track. In general, the connection comprises a first and second pair of surfaces, with the first pair located adjacent the first rail or side of the track. One surface of the first and second pairs is on the track and the other surface of each of the first and second pairs is on the product pusher. The first and second pairs of surfaces engage to resist separation of the product pusher from the track. Additionally, there is a third pair of surfaces located between the first rail or side of the track and the second rail or side of the track. One surface of the third pair is on the track and the other surface of the third pair is on the product pusher. The third pair of surfaces engages to resist separation of the product pusher from the track. Preferably, with reference to FIGS. 6 and 9, the first and second pair of surfaces generally comprise the interaction between the outside flanges 122 of the pusher block 112 and the rails/ridges 72, while the third pair of surfaces generally comprise at least one arm 128 of the middle pusher block flange and another surface of the rails/ridges 78. With reference now to FIGS. 1 and 6–9, the product pusher or pusher block 112 in the preferred embodiment will be described in further detail. The pusher block 112 generally comprises the spring carrier surface 110, a pushing surface 114, a sliding surface 116, and two sets of opposing flanges 118. As explained, the opposing flanges 118, generally capture the rails or ridges 72 of the product track 70 to maintain a positive lock on the product track 70 by the pusher block 112. As illustrated in FIG. 8, the pushing surface 114 extends generally normal to the upper surface of the product track 70. The pushing surface 114 is designed to allow the pusher block 112 to maintain contact with the packaging positioned directly in front of the pusher block 112. The spring carrier surface 110 and the sliding surface 116 are generally formed from the same section of material which extends rearward of the pushing surface 114 along a direction generally perpendicular to the pushing surface 114. In the illustrated embodiment in FIGS. 6 and 7, a pair of gussets 120 support the relationship between the pushing surface 114 and the spring carrier surface 110. The outer edges of the spring carrier surface 110 are rolled downward and inward in the illustrated embodiment. These rolled edges form one of the opposing flanges of each of the two sets of opposing flanges. Along the spring carrier surface 110, proximate the central portion of the spring carrier surface are two ridges 121. These ridges serve to maintain the position of the roll spring 100 on the pusher block 112.

Figure 9:
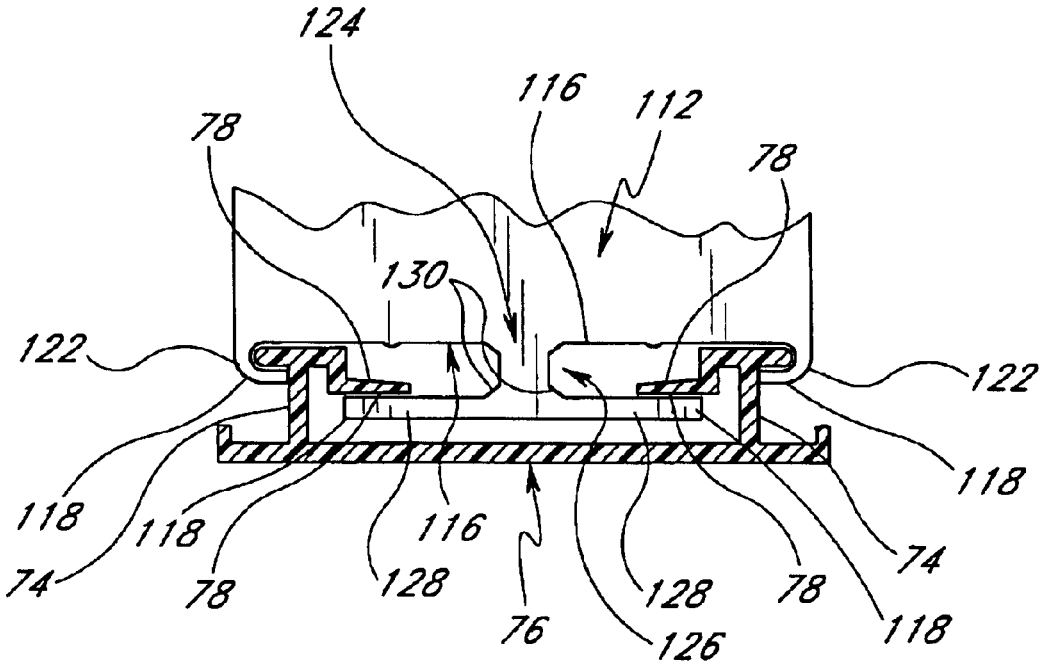
FIG. 9 is a front view of the pusher block and product track of the present invention.

With reference now to FIG. 9, as well as FIG. 6, the second of the opposing flanges is formed by a generally T-shaped boss 124 which extends downward from the sliding surface 116. The T-shaped boss 124 is designed to slide under the lower-most edge of the tie down surface 78. The T preferably has a pair of chamfers 130 formed along its stem 126. Specifically, the chamfers 130 are formed between the sliding surface 116 and the stem 126 and the stem 126 and the laterally extending arms 128. Through the use of the arms 128 and the rolled edges, the two sets of opposing flanges grip each of the rails 72 of the product track 70 to form a positive lock between the product track 70 and the pusher block 112. This positive lock reduces the likelihood of the pusher block 112 separating from the product track 70 under high load. The chamfers 130 reduce the contact surface area between the product track 70 and the pusher block 112 as well as center a vertical direction the pusher block 112 on the product track 70. Moreover, the bottom edge of the arms 128 serve to direct the roll spring 100 down toward the lower-most surface of the track, as well as serve to provide an idler arm to the roll spring 100 in some embodiments.

Various accessories may be added to the adjustable display rack 10 configured and arranged in accordance with the present invention. For instance, with reference to FIGS. 6 and 7, an increased size pushing paddle 140 is illustrated therein. The pushing paddle 140 increases the contact surface area between the product being moved forward and the pusher block 112. Specifically, the paddle 140 is arranged with a pair of inwardly extending flanges 142 that are sized and configured to create a channel that slip fits over the pushing surface 114 of the pusher block 112. Moreover, the paddle 140 comprises a pair of ridges 144 that decrease the contact area between the paddle 140 and the pushing surface 114 such that the paddle may be easily removed or positioned on the pushing surface 114 as desired. The paddle 140 can also be used as in FIG. 3 as a spacing member. It should be appreciated that the spacing member can optionally be used to secure the track in position and stably increase or decrease the separation of the tracks or tracks and dividers to accommodate merchandise of different widths.

Generally, the adjustable display rack 10 may be comprised of any suitable material. Materials presently preferred are materials from the styrene family or self-lubricating FDA approved plastics, such as, but not limited to, acrylonitrile-butadiene-styrene (ABS). In some embodiments, however, the components may be manufactured from stainless steel, UHMW, or other FDA approved materials. The materials are chosen to allow for easy cleaning and reduce adsorption of liquids. In applications not involving food products, the materials may be chosen from any material considered desirable to those of the user. Where materials are not judiciously chosen to result in a self-lubricating nature to the product, materials such as brass or bronze or any other bearing type surface material may be utilized with steels and the like. Additionally, a silicon spray may be used to coat the surfaces to increase the lubrication between the moving components. In some embodiments, the front panel 20 may be opaque, transparent or translucent. In the present and preferred embodiment, the front panel 20 is comprised of a clear plastic material to allow the prospective purchaser a clear line of vision to the product being carried by the adjustable display rack 10.

In use, the display rack is sized and configured using various product tracks 70 and dividers 90 to closely approximate the size of the packaging of the products being carried. It is anticipated that multiple product tracks 70 may be aligned side-by-side to carry heavier products such that a divider need not be placed directly between each and every product track 70. Once the sizing is complete, the frame may be closed in embodiments having a removable end piece 50. The end pieces 50 and 52 may be a product track 70 or a dividing wall 90. With the assembly complete, product may be loaded into the display rack 10 by pulling the pusher block 112 toward the rear panel 22 while stocking the product forward of the pusher block 112. As products are removed from between the pusher block 112 and the front panel 20, the pusher block will be urged forward under the bias of the roll spring 100 until the supply of product is depleted. When restocking, the pusher block 112 is simply slid rearward and the new product is positioned rearward of the old product to ensure a continuous cycling of product.

The ability to slidably move the tracks and dividers, the ability to add and remove tracks and dividers, and the ease with which this is done makes the display rack of the present invention infinitely variable with respect to width of a product.

It will be appreciated that the display rack of the present invention is extremely versatile and can be constructed and configured to display products of varying size and configuration in side by side relation. For example, a mixture of wider and thinner products could be displayed in the same rack by simply varying the width of the product tracks and dividers or adding different sized product tracks and dividers. In addition, products with a wide variety of heights can be displayed by varying the height of the front panel, or varying the size of the pusher block by adding variously sized spacer blocks. Although, the preferred embodiments of the invention have been described, various modifications come to mind without departing from the spirit of the invention.

The dividers and the product tracks, for instance, could assume any configuration as long as they are still slidably and stably positioned into the races at the front and back of the display rack. The attachment at the front and the back allows for greater stability of the products and the display rack. The display rack could also be made in a variety of sizes to accommodate much larger products.

Although the present invention has been described in terms of certain embodiments, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. A pusher block and track combination comprising:

a track comprising:

a first raised rail and a second raised rail, said first raised rail and said second raised rail extending generally parallel with each other, said first raised rail comprising a first product supporting surface and a first bottom surface, said first rail further comprising a first outside edge surface and a first inside edge surface, said first outside edge surface and said first inside edge surface extending between said first product supporting surface and said first bottom surface, said second raised rail comprising a second product supporting surface and a second bottom surface, said second rail further comprising a second outside edge surface and a second inside edge surface, said second outside edge surface and said second inside edge surface extending between said second product supporting surface and said second bottom surface, said first inside edge surface and said second inside edge surface being disposed between said first outside edge surface and said second outside edge surface, a pusher block comprising:

a sliding surface being adapted to slide along said first product supporting surface and said second product supporting surface, a first outside flange disposed to a first side of said pusher block and adapted to wrap around said first outside edge surface and a portion of said first bottom surface, a second outside flange disposed to a second side of said pusher block and adapted to wrap around said second outside edge surface and a portion of said second bottom surface, a T-shaped boss extending below said sliding surface and comprising a first arm and a second arm, said first arm extending below said first rail and said second arm extending below said second rail, said first and second outside flanges and said first and second arms cooperating such that said pusher block covers at least a portion of said first and second product supporting surfaces, said first and second outside edge surfaces, said first and second inside edge surfaces and said first and second bottom surfaces.

2. The combination of claim 1, wherein an inner portion of said first bottom surface and an inner portion of said second bottom surface are lower than an outer portion of said first bottom surface and an outer portion of said second bottom surface and said first and second arms extend below said inner portions of said first and second bottom surfaces.

3. The combination of claim 2, wherein said first rail comprises a first generally vertically extending rib, said first rib being disposed between said inner portion of said first bottom surface and said outer portion of said first bottom surface, and said second rail comprises a second generally vertically extending rib, said second rib being disposed between said inner portion of said second bottom surface and said outer portion of said second bottom surface.

4. The combination of claim 3, wherein said first rib separates said first flange from said first arm and said second rib separates said second flange from said second arm.

5. The pusher block and track combination of claim 1 further comprising a spacer block which can be stably fitted onto said pusher block to increase the height or width to allow for use with taller or wider products, said spacer block comprising at least one flange that cooperates with said pusher block to secure said spacer block to said pusher block.

6. The combination of claim 1 further comprising a roll spring that rests on a rearward portion of said pusher block and that extends forward under said pusher block, a bottom surface of said arms directing a portion of said roll spring downward.

7. A pusher block and track combination comprising:

a track comprising:

a first raised rail and a second raised rail, said first raised rail and said second raised rail extending generally parallel with each other, said first raised rail comprising a first top surface, a first bottom surface, a first outside surface and a first inside surface, said second raised rail comprising a second top surface, a second bottom surface, a second outside surface and a second inside surface, a pusher block comprising:

a main body comprising a sliding surface adapted to slide along said first and second top surfaces, a first outside flange, a second outside flange, a first inside flange and a second inside flange depending from said main body, said first outside flange extending around said first outside surface and a portion of said first bottom surface, said first inside flange extending around said first inside surface and a portion of said first bottom surface, said second outside flange extending around said second outside surface and a portion of said second bottom surface, said second inside flange extending around said second inside surface and a portion of said second bottom surface, such that, together, said main body, said first outside flange and said first inside flange capture said first rail and said main body, said second outside flange and said second inside flange capture said second rail, and wherein the first and second inside flanges are configured to engage portions of the first and second bottom surfaces while the sliding surface engages the first and second top surfaces throughout a sliding motion of the pusher block along the first and second raised rails.

8. The combination of claim 7, wherein said first inside flange and said second inside flange each are formed, in part, by a central stem.

9. The combination of claim 8, wherein said first inside flange comprises a first arm that extends outward from said stem and said second inside flange comprises a second arm that extends outward from said stem.

10. The combination of claim 9 further comprising a first chamfer between said first arm and said stem and a second chamfer between said second arm and said stem.

11. The combination of claim 7, wherein said first outside flange and said first inside flange do not overlap in a vertical direction.

12. The combination of claim 7, wherein said first inside flange and said second inside flange are completely positioned between said first outside flange and said second outside flange.

13. The combination of claim 7, further comprising a roll spring that rests on a rearward portion of said pusher block and that extends forward under said pusher block, a bottom surface of said inside flanges directing a portion of said roll spring downward.

* * * * *